United States Patent [19]

Sierk et al.

[11] 4,454,783

[45] Jun. 19, 1984

[54] DIESEL ENGINE CONTROL LINKAGE

[75] Inventors: Randall L. Sierk, New Holland; Lonny R. Freitag, Lancaster, both of Pa.

[73] Assignee: Sperry Corporation, New Holland, Pa.

[21] Appl. No.: 369,692

[22] Filed: Apr. 19, 1982

[51] Int. Cl.[3] ..... G05G 9/08

[52] U.S. Cl. ..... 74/471 R; 74/470; 74/480 R; 123/198 DB; 123/372; 137/614.11; 137/630.19; 180/335

[58] Field of Search ..... 74/470, 471 R, 480 R; 123/198 DB, 372; 180/335; 137/614.11, 630.19

[56] References Cited

U.S. PATENT DOCUMENTS

| | | | |
|---|---|---|---|
| 2,365,412 | 12/1944 | Janes | 123/342 X |
| 2,480,083 | 8/1949 | McMillan | 74/471 |
| 2,584,055 | 1/1952 | Smith | 74/471 |
| 3,067,628 | 12/1962 | Haworth et al. | 74/471 |
| 3,181,565 | 5/1965 | Haskins | 137/630.19 X |
| 4,169,443 | 10/1979 | Todeschini | 123/139 R |
| 4,254,753 | 3/1981 | Ritter et al. | 123/140 MC |

*Primary Examiner*—Allan D. Herrmann

*Attorney, Agent, or Firm*—Larry W. Miller; Frank A. Seemar; Darrell F. Marquette

[57] ABSTRACT

A control linkage for a diesel engine in a skid-steer loader is disclosed wherein the control rods for both the fuel shut-off valve and the rate of flow control valve are operably interconnected by a bracket slidably receiving the control rods. The bracket is actuatable by a single control lever in the operator's compartment to vary the rate of flow of fuel to the engine without manipulating the fuel shut-off valve and to terminate the flow of fuel by manipulating the shut-off valve after the rate of fuel flow has been reduced to a predetermined point.

14 Claims, 7 Drawing Figures

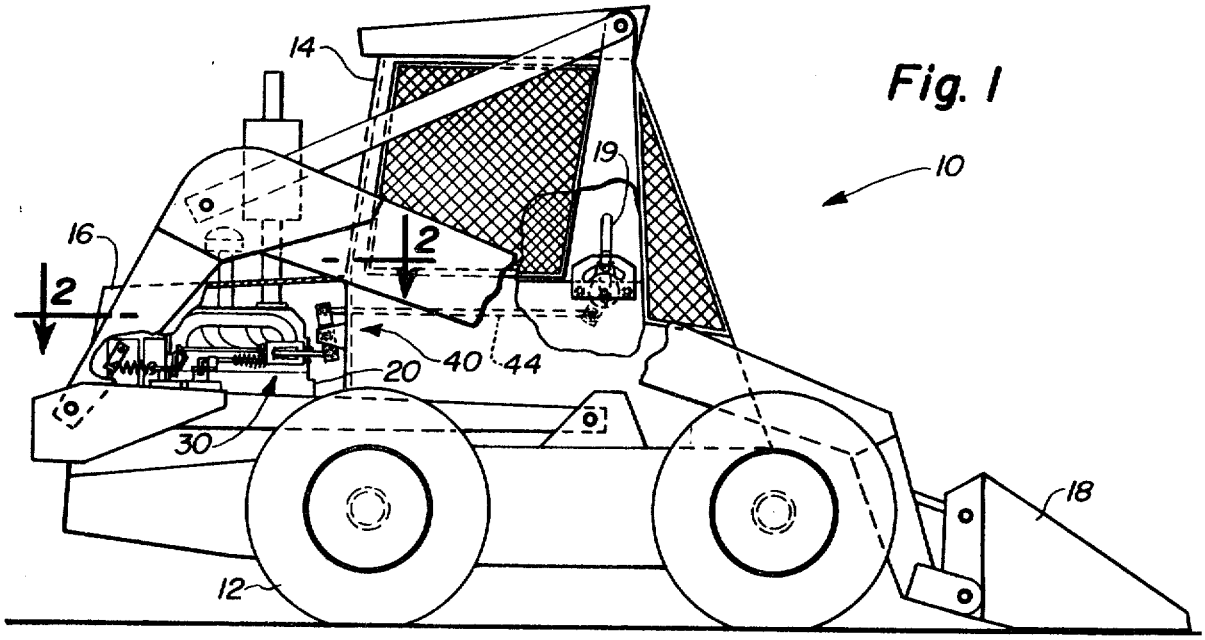
Fig. 1
Fig. 2
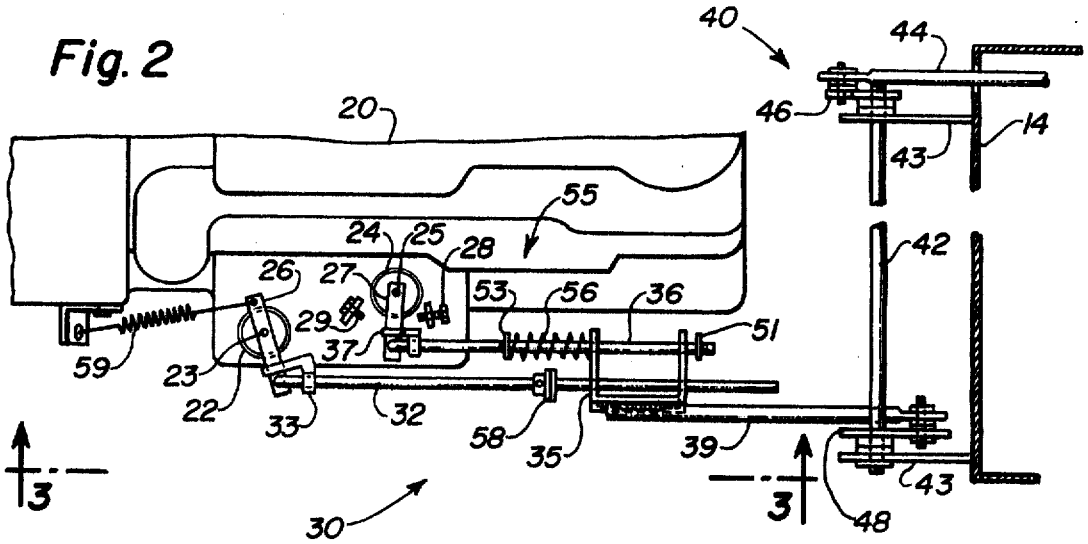
Fig. 3
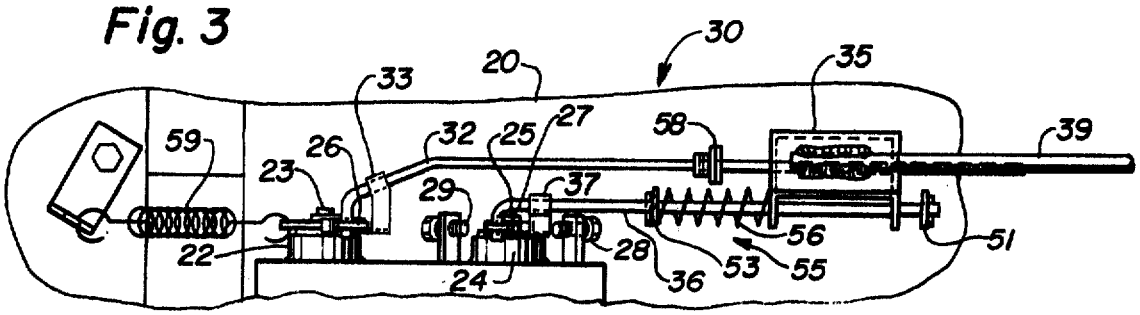

DIESEL ENGINE CONTROL LINKAGE

BACKGROUND OF THE INVENTION

The present invention relates generally to diesel engines and, more particularly, to a single lever control linkage for actuating both the fuel shut-off control and the rate of flow of fuel control on diesel engines used in skid-steer loaders.

Generally, skid-steer loaders are fixed, wheeled machines that steer through a differential in speed of the wheels on the opposing sides of the loader. The loader will typically have an operator's compartment in which the controls for operating the machine are located and an engine compartment in which the engine is mounted on the frame. Although either gasoline or diesel engines could be used in powering the loader, some diesel engines have separate controls for operating the fuel shut-off valve and the valve for regulating the rate of fuel flow to the engine.

Such diesel engines, such as the Model 4.108 diesel engine manufactured by Perkins Engines, Inc. will require that separate controls, corresponding to the fuel shut-off and fuel flow regulation valves, be located in the operator's compartment to actuate these engine functions. It has been found to be desirable to control both valves for regulating the rate of fuel flow and the termination of the flow of fuel to the engine after the rate of flow has been reduced to a predetermined point by a single control lever in the operator's compartment.

SUMMARY OF THE INVENTION

It is an object of this invention to overcome the aforementioned disadvantages of the prior art by providing a control linkage actuatable by a single control lever in the operator's compartment to control both the fuel shut-off valve and the valve for regulating the flow of fuel in a diesel engine.

It is another object of this invention to provide a control linkage to actuate both the fuel shut-off valve and the rate of fuel flow valve on a diesel engine through manipulation of a single control lever.

It is an advantage of this invention that the operator of a skid-steer loader can more conveniently control the fuel flow functions of a diesel engine powering the loader.

It is still another object of this invention to provide a bracket slidably receiving control rods for operatively actuating the valves for controlling the flow of fuel to a diesel engine and stops positioned along the respective control rods to engage the bracket and permit the actuation of the rate of flow valve without actuating the fuel shut-off valve until the rate of fuel flow has been reduced to a predetermined point.

It is a feature of this invention that the fuel shut-off valve is not actuated until the rate of fuel flow has been reduced to a predetermined value, corresponding to the slow idle speed of the engine.

It is another feature of this invention that the fuel shut-off valve is spring loaded to the "on" position, such that the flow of fuel to the diesel engine is not terminated unless the control lever is manipulated to overcome the biasing force and move the fuel shut-off valve to the "off" position.

It is a further object of this invention to provide a lost motion mechanism to permit the bracket to move the control rod corresponding to the fuel shut-off valve without further movement of the control rod corresponding to the rate of flow valve after the rate of fuel flow has reached a predetermined point.

It is a further feature of this invention that the stops limiting movement of the control arm corresponding to the rate of fuel flow valve beyond predetermined points are adjustable to selectively vary the predetermined point at which the control arm should stop moving.

It is yet a further object of this invention to provide a single lever control linkage to actuate two separate fuel control valves on a diesel engine in a skid-steer loader which is durable in construction, inexpensive of manufacture, carefree of maintenance, facile in assemblage and simple and effective in use.

These and other objects, features and advantages are accomplished according to the instant invention by providing a control linkage for a diesel engine in a skid-steer loader wherein the control rods for both the fuel shut-off valve and the rate of flow control valve are operably interconnected by a bracket slidably receiving the control rods. The bracket is actuatable by a single control lever in the operator's compartment to vary the rate of flow of fuel to the engine without manipulating the fuel shut-off valve and to terminate the flow of fuel by manipulating the shut-off valve after the rate of fuel flow has been reduced to a predetermined point.

BRIEF DESCRIPTION OF THE DRAWINGS

The advantages of this invention will become apparent upon consideration of the following detailed disclosure of the invention, especially when taken in conjunction with the accompanying drawings wherein:

FIG. 1 is a side-elevational view of a skid-steer loader incorporating the principles of the instant invention, a portion of the side wall of the operator's compartment being broken away to better show the single lever control in the operator's compartment;

FIG. 2 is an enlarged partial cross-sectional view of the loader seen in FIG. 1 and taken along lines 2—2, most of the engine and frame being broken away and removed to better show the control linkage extending from the engine into the operator's compartment;

FIG. 3 is a partial side-elevational view of the control linkage seen in FIG. 2 and taken along lines 3—3;

DETAILED DESCRIPTION OF THE PREFERRED EMBODIMENT

Figure 4:
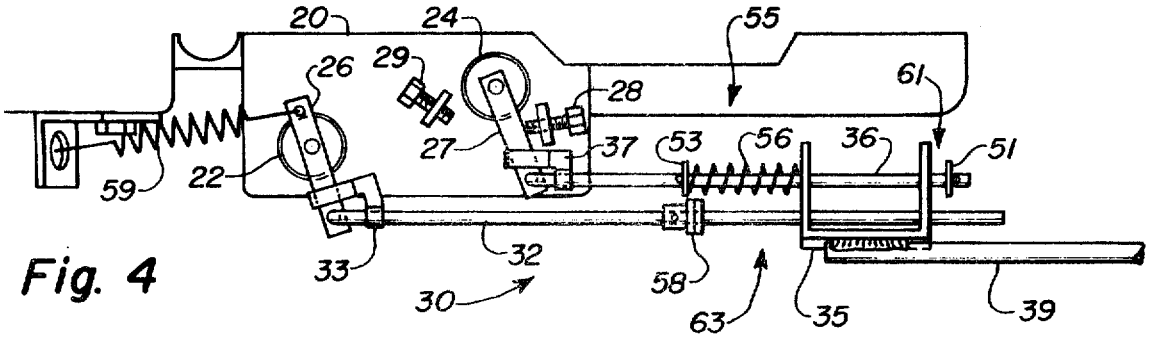
FIGS. 4–7 are top-plane views of the control linkage corresponding to the view seen in FIG. 2, sequentially showing the operation of the control linkage in actuating the fuel shut-off valve and the valve for regulating the rate of fuel flow from a full throttle position to a fuel shut-off position.

Referring now to the drawings and, particularly, to FIG. 1, a side-elevational view of a skid-steer loader incorporating the principles of the instant invention can be seen. The loader 10 includes a wheeled frame 12 on which is mounted an operator's compartment 14 and an engine compartment 16 immediately behind the operator's compartment 14. The different controls, not shown, for manipulating the various functions of the loader 10 such as steering and raising, lowering and tilting the bucket 18, as well as the operator's seat, have been removed for clarity. The control lever 19 is conveniently located in the operator's compartment 14 within easy reach of the operator, not shown. The linkage 30 operatively interconnecting the control lever 19 with the fuel control valves on the engine 20 are described in detail below.

Referring now to FIGS. 2 and 3, an enlarged view of the control linkage 30 can be seen. The diesel engine 20 is mounted on the frame 12 for operatively powering the loader 10. A first valve 22 for controlling the flow of fuel to the engine 20 is mounted on the engine 20 and movable between an "on" position in which fuel is permitted to flow toward the engine 20 and an "off" position in which fuel is prevented from flowing toward or into the engine 20. A second valve 24 is also mounted on the engine 20 and is operable to substantially infinitely vary the rate of flow of the fuel to the engine 20 between a slow idle position and a full speed position.

Both valves 22,24 are rotatably moved from one position to another about an axis of rotation 23,25, respectively. Actuation tabs 26,27 are connected to the valves 22,24, respectively, to extend outwardly from the corresponding axis of rotation 23,25 for effecting a rotative movement of the corresponding valve 22,24 upon the generally linear movement thereof as described below. First and second limits 28,29 are mounted on the engine 20 on opposing sides of the actuation tab 27 to be engagable therewith to limit the maximum and minimum fuel flow rates between the full speed and slow idle positions, respectively. The limits 28,29 can be made adjustable in position relative to the actuation tab 27 to vary the engine speed at either the full throttle or slow idle positions.

A first elongated control rod 32 is connected to the actuation tab 27 on the fuel shut-off valve 22 by a pivotable connection bracket 33 and slidably received within a generally U-shaped bracket 35. A second elongated control rod 36 is similarly connected to the actuation tab 27 on the flow rate valve 24 by a pivotable connection bracket 37 and is also slidably received within bracket 35. To permit a sliding movement along both control rods 32,36, the bracket 35 receives the control rods 32,36 in a parallel relationship.

An actuation member 39 in the form of an elongated rod is affixed to the bracket 35 for movement therewith. An actuation linkage 40 interconnects the control lever 19 and the actuation member 39 to cause a corresponding movement of the bracket 35 relative to the control rods 32,36 whenever the control lever 19 is operatively moved. The actuation linkage 40 includes a transverse cross shaft 42 rotatably mounted to the rear of the operator's compartment by brackets 43 and a fore-and-aft extending elongated rod-like member 44. The rod-like member 44 is pivotally connected to the control lever 19 and extends rearwardly therefrom for pivotal connection to the cross shaft 42 via a connection linkage 46.

Similarly, the actuation member 39 is pivotally connected to the cross shaft 42 by a connection linkage 48. The various components of the actuation linkage 40 are arranged so that when the control lever 19 is moved forwardly, toward the bucket 18 as seen in FIG. 1, the actuation member 39 and affixed bracket 35 are correspondingly moved in a first forward direction. to increase the engine speed, as will be described in further detail below. Likewise, when the control lever 19 is moved in a rearward direction, away from the bucket 18 as seen in FIG. 1, the bracket 35 will be moved in a second rearward direction relative to the control rods 32,36 to effect a decrease in engine speed and/or a termination of the flow of fuel, as will also be described in further detail below.

A first stop 51 is affixed to the control rod 36 forwardly of the bracket 35 to engage the bracket 35 as it is moved in the first forward direction and effect a corresponding movement of the control rod 36, thereby causing the valve 24 to rotate due to the connection between the control rod 36 and the actuation tab 28 to increase the rate of flow of fuel to the engine 20. Similarly, a second stop 53 is affixed to the control rod 36 rearwardly of the bracket 35 to effect a rotation of the valve 24 to decrease the rate of fuel flow to the engine 20 whenever the bracket 35 is moved in the second rearward direction.

A lost motion mechanism 55 is provided to permit further movement of the bracket 35 in the second rearward direction after the actuation tab 27 has contacted the limit 29, thereby preventing further rearward movement of the control rod 36. The lost motion mechanism 55 includes a spring 56 concentrically mounted on the control rod 36 between the bracket 35 and the second stop 53. The movement of the bracket 35 in the second rearward direction causes the bracket 35 to push the spring 56 against the second stop 53 and, thereby, effect a corresponding movement of the control rod 36 in the second rearward direction.

A third stop 58 is affixed to the control rod 32 rearwardly of the bracket 35 at a position where the bracket 35 will contact the third stop 58 when the control rod 36 has moved the actuation tab 27 against the limit 29. Further movement of the bracket 35 in the second rearward direction will effect a corresponding movement of the control rod 32 to rotate the valve 22 to cause a termination of the flow of fuel to the engine 20. The valve 22 is spring-loaded to the "on" position by means of the spring 59 interconnecting the actuation tab 26 and the engine 20. Therefore, when the bracket 35 is moved in the first forward direction after moving the valve 22 to the "off" position, the valve 22 will automatically be moved to its "on" position. It should be noted that the control rod 32 is generally stationary as the control rod 36 is moved between the slow idle and full speed positions, with the bracket 35 sliding along the control rod 32. The control rod 32 is of sufficient length to accommodate the movement of the bracket 35 in the first forward direction until the control rod 36 has reached its full speed position.

Referring now to FIGS. 4–7, the operation of the control linkage 30 to move the valves 22,24 from the full speed position to the fuel shut-off position can be seen. In FIG. 4, the valve 22 is in the "on" position and the valve 24 is in the full speed position with the actuation tab 27 engaging the limit 28. The bracket 35 has been moved slightly in the second rearward direction to engage the second stop 53, disengaging from the first stop 51. The gap 61 between the first stop 51 and the bracket 35 has been illustrated for demonstrative purposes only, as one skilled in the art will readily realize that providing a gap 61 will provide a corresponding amount of generally undesirable "free play" in the system, resulting in a requirement of an amount of movement of the control lever 19 before effecting a change in the engine speed. Elimination of the gap 61 will eliminate most of this "free play."

Figure 5:
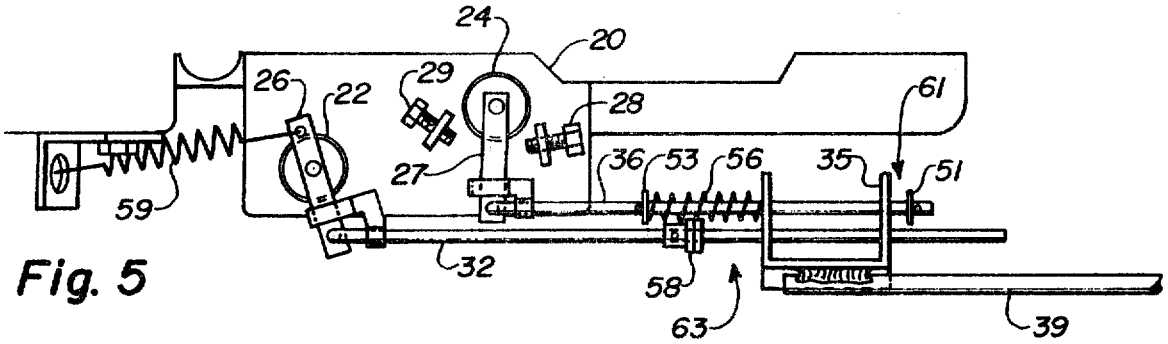

In FIG. 5, the valve 24 has been moved to a mid-range position. The movement of the bracket 35 in the second rearward direction has caused the spring 56 to engage the second stop 53 and move the control rod 36 to position the actuation tab 27 approximately midway between the limits 28,29. The bracket 35 has slid along the control rod 32 without effecting any movement thereof, causing the distance 63 between the bracket 35 and the third stop 58 to decrease. The valve 22 remains in the "on" position.

Figure 6:
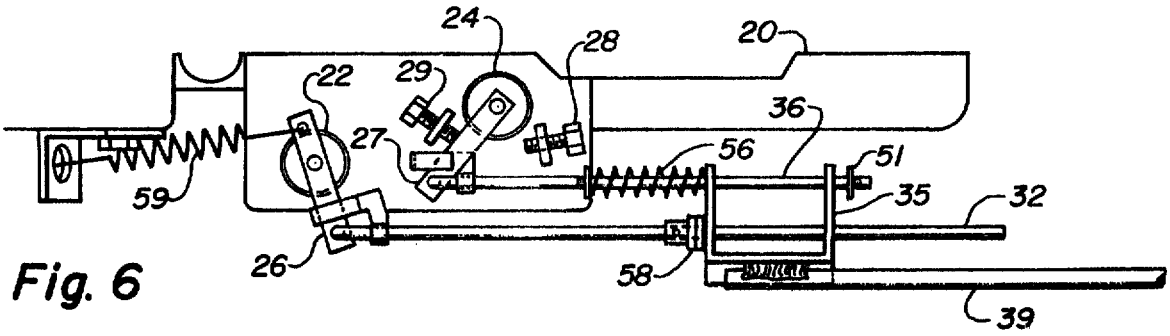

In FIG. 6, the valve 24 has been moved to a slow idle position. The rearwardly moving bracket 35 has caused the control rod 36 to position the actuation tab 27 against the limit 29, rotating the valve 24 to its minimum flow rate position. The bracket 35 has continued to slide along the control rod 32 without effecting any movement thereof and, as a result, the valve 22 remains in the "on" position. The third stop 58 has been positioned along the control rod 32 such that the bracket 35 engages the third stop 58 at approximately the same time as the actuation tab 27 engages the limit 29.

Figure 7:
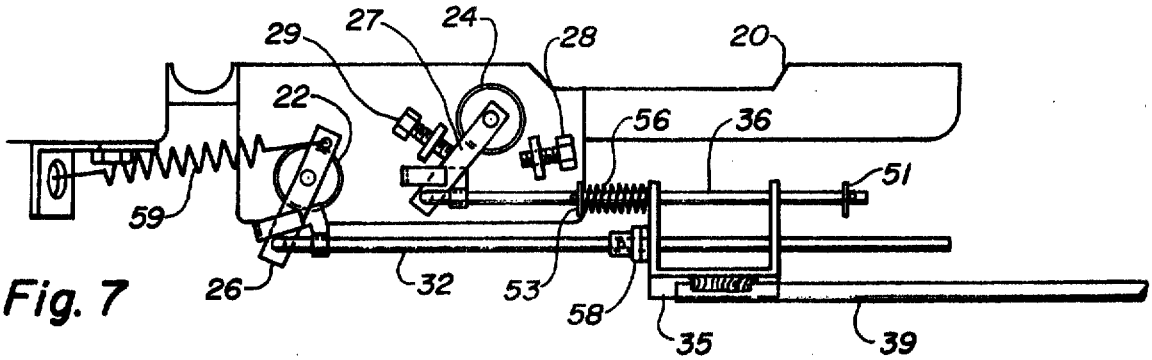

FIG. 7, the valve 24 remains in the slow idle position with the actuation tab 27 contacting the limit 29, which prevents the control rod 36 from any further movement in the second rearward position. The bracket 35, however, has continued to move further rearwardly from the position seen in FIG. 6, compressing the spring 56 to prevent damage from being done to any components of the control linkage 30 or the valve 24 due to the continued movement of the bracket 35 and the inability of the control rod 36 to move. The rearwardly moving bracket 35 does effect movement of the control rod 32 in the second rearward direction because of the engagement between the bracket 35 and the third stop 58. The rearward movement of the control rod 32 overpowers the biasing force exerted by the spring 59 and moves the valve 22 to its "off" position, terminating the flow of fuel to the engine 20.

The operation of the control linkage 30 to move the valves 22,24 from the fuel shut-off position to the full speed position is substantially the reverse of the operation described above. Manipulation of the control lever 19 to effect a movement of the bracket 35 in the first forward direction enables the spring 59 to move the control rod 32 in the first forward direction until the valve 22 moves to the "on" position as seen in FIGS. 4–6. The forward movement of the bracket 35 from the position seen in FIG. 7 allows the spring 56 to decompress without effecting any movement of the control rod 36. Sufficient forward movement of the bracket 35 will enable the bracket 35 to engage the first stop 51 and then effect movement of the control rod 36 in the first forward direction. The control rod 32 remains substantially stationary after the valve 22 reaches the "on" position, the bracket 35 sliding along the length thereof while the valve 24 is moved between its slow idle and full speed positions.

It will be understood that changes in the details, materials, steps and arrangements of parts which have been described and illustrated to explain the nature of the invention, will occur to and may be made by those skilled in the art upon a reading of the disclosure within the principles and scope of the invention. The foregoing description illustrates preferred embodiments of the invention. However, concepts, as based upon such a description, may be employed in other embodiments without departing from the scope of the invention. Accordingly, the following claims are intended to protect the invention broadly as well as in the specific form shown herein.

Having thus described the invention, what is claimed is:

1. In a diesel engine having a first control operable to terminate the flow of fuel to the engine through manipulation of a first linear control rod and a second control operable through manipulation of a second linear control rod to vary the rate of flow of fuel to said engine from a slow speed to a fast speed, an improved control linkage comprising:

a bracket slidably mounted on both said first and second control rods;

an actuation member affixed to said bracket such that selective manipulation of said actuation member will effect a sliding movement of said bracket along the length of said first and second control rods in a first direction and an opposing second direction, respectively;

first and second stops affixed to said second control rod, said first stop being positioned such that when said bracket moves in said first direction said bracket will engage said first stop and effect a movement of said second control rod to increase the rate of flow of fuel to said engine, said second stop being positioned such that movement of said bracket in said second direction will effect engagement of said second stop to effect movement of said second control rod to decrease the rate of flow of fuel to said engine;

A third stop affixed to said first control rod such that said bracket will engage said third stop after said second control rod has been moved in said second direction to decrease said flow rate to a predetermined value, further movement of said bracket in said second direction effecting a termination of the flow of fuel to said engine; and lost motion means operatively associated with said second control to permit the movement of said first control rod in said second direction after said bracket has engaged said third stop without effecting further movement of said second control rod.

2. The diesel engine of claim 1 wherein said lost motion means is mounted on said second control rod between said bracket and said second stop, said bracket effecting movement of said second control rod by engagement of said second stop through said lost motion means.

3. The diesel engine of claim 2 wherein said lost motion means includes a spring concentrically mounted on said second control rod between said second stop and said bracket.

4. The diesel engine of claim 3 wherein said second control is rotatably actuated through a first lever interconnecting the axis of rotation of said second control and said second control rod, said second control further including first and second limits engagable with said first lever to limit the movement of said second control rod in said first and second directions, respectively, said bracket effecting movement of said second control rod by engaging said second stop through said spring, said bracket compressing said spring against said second stop after said first lever engages said second limit to effect further movement of said first control rod without effecting movement of said second control rod.

5. The diesel engine of claim 4 wherein said second limit limits the reduction of fuel flow rate to a point corresponding to slow idle, said second limit being adjustable to vary the slow idle speed.

6. The diesel engine of claim 4 wherein said first control is rotatably actuated through a second lever interconnecting the axis of rotation of said first control and said first control rod, said first control being movable between a fuel shut-off position and a fuel flow position, said first control being moved to said fuel shut-off position when said bracket engages said third stop and effects movement of said first control rod in said second direction, said first control being biased toward said fuel flow position.

7. The diesel engine of claim 6 further comprising a spring interconnecting said engine and said second lever to bias said first control toward said fuel flow position.

8. The diesel engine of claim 6 wherein said actuation member is operable to effect movement of said bracket in said first and second directions at a location remotely spaced from said engine.

9. In a skid-steer loader having a mobile frame; an operator's compartment mounted on said frame; an engine compartment mounted on said frame adjacent said operator's compartment; and a diesel engine mounted on said frame within said engine compartment for operatively powering said loader, said engine having a first fuel control operable between a fuel shut-off position and a fuel flow position by a first control rod and a second fuel control operable to vary the rate of flow of fuel into the engine between a slow idle speed and a fast speed by a second control rod, an improved control linkage comprising:

a bracket slidably mounted on both said first and second control rods;

an actuation member affixed to said bracket such that selective manipulation of said actuation will effect a sliding movement of said bracket along the length of said first and second control rods in a first direction and an opposing second direction, respectively;

first and second stops affixed to said second control rod, said first stop being positioned such that when said bracket moves in said first direction said bracket will engage said first stop and effect a movement of said second control rod in said first direction to operate said second control to increase the rate of flow of fuel to said engine, said second stop being positioned such that movement of said bracket in said second direction will effect engagement of said second stop to effect movement of said second control rod in said second direction to operate said second control to decrease the rate of flow of fuel to said engine;

a third stop affixed to said first control rod such that said bracket will engage said third stop after said second control rod has moved said second control to a position corresponding to said slow idle speed, further movement of said bracket in said second direction effecting a movement of said first control rod to operatively move said first control to said fuel shut-off position;

lost motion means operatively associated with said second control to permit the movement of said first control rod in said second direction after said bracket has engaged said third stop without effecting further movement of said second control rod; and connecting linkage interconnecting said actuation member with a single fuel control actuator positioned within said operator's compartment.

10. The loader of claim 9 wherein said lost motion means is mounted on said second control rod between said bracket and said second stop, said bracket effecting movement of said second control rod by engagement of said second stop through said lost motion means.

11. The loader of claim 10 wherein said lost motion means includes a spring concentrically mounted on said second control rod between said second stop and said bracket.

12. The loader of claim 11 wherein said second control is rotatably actuated through a first lever interconnecting the axis of rotation of said second control and said second control rod, said second control further including first and second limits engagable with said first lever to limit the movement of said second control rod in said first and second directions, respectively, said bracket effecting movement of said second control rod by engaging said second stop through said spring, said bracket compressing said spring against said second stop after said first lever engages said second limit to effect further movement of said first control rod without effecting movement of said second control rod.

13. The loader of claim 12 wherein said first fuel control is spring-loaded toward said fuel flow position, said first fuel control being moved to said fuel shut-off position when said bracket engages said third stop to effect movement of said first control rod in said second direction.

14. The loader of claim 13 wherein said fuel control actuator is pivotally mounted to said operator's compartment, said connecting linkage including a cross shaft rotatably mounted on said frame and pivotally connected to said actuation member such that rotation of said cross shaft will cause a movement of said actuation member in said first and second directions, respectively, and a link interconnecting said fuel control actuator and said cross shaft such that selective movement of said fuel control actuator will rotate said cross shaft and effect a corresponding movement in said actuation member.

* * * * *